US006649882B1

(12) United States Patent
Hervieu et al.

(10) Patent No.: US 6,649,882 B1
(45) Date of Patent: Nov. 18, 2003

(54) ELECTRIC ION WITH SAFETY SYSTEM CONTROLLING ELECTRIC HEATER DEPENDING ON TOTAL SUPPLY TIME

(75) Inventors: Benoît Hervieu, Luc ser Mer (FR); Joseph Letorey, Varaville (FR)

(73) Assignee: SEB S.A., Ecully Cedex (FR)

( * ) Notice: Subject to any disclaimer, the term of this patent is extended or adjusted under 35 U.S.C. 154(b) by 0 days.

(21) Appl. No.: 09/700,110

(22) PCT Filed: May 11, 1999

(86) PCT No.: PCT/FR99/01117

§ 371 (c)(1),
(2), (4) Date: Mar. 22, 2001

(87) PCT Pub. No.: WO99/58754

PCT Pub. Date: Nov. 18, 1999

(30) Foreign Application Priority Data

May 12, 1998 (FR) ..... 98 06443

(51) Int. Cl.[7] ..... D06F 75/00; H05B 1/02

(52) U.S. Cl. ..... 219/494; 219/251; 219/257; 38/82

(58) Field of Search ..... 219/250–252, 219/257, 494; 38/82, 74

(56) References Cited

U.S. PATENT DOCUMENTS 4,520,257 A * 5/1985 Schwob et al. ..... 219/250
5,039,838 A * 8/1991 Ito et al. ..... 38/82

FOREIGN PATENT DOCUMENTS

| | | |
|---|---|---|
| DE | 37 03 884 | 8/1988 |
| JP | 61-222492 | * 10/1986 |
| JP | 61-222493 | * 10/1986 |
| JP | 62-261399 | * 11/1987 |
| JP | 3-173600 | * 7/1991 |
| JP | 6-225996 | * 8/1994 |
| WO | WO 82/03520 | 10/1982 |

* cited by examiner

*Primary Examiner*—John A. Jeffery
(74) *Attorney, Agent, or Firm*—Young & Thompson

(57) ABSTRACT

An iron comprises a sole plate heated by an electrical resistance and a heat-regulating system, wherein a control member indicates the temperature set value, a sensor displays the sole plate temperature, and a management system controls the electrical resistance power supply circuit to be opened or closed, on the basis of the difference between the set value and the measurement. The iron comprises a safety system comprising an electronic module, which: a) receives from the management system information for closing the electrical resistance power supply circuit; b) produces over a fixed time interval the total supply times; and c) opens the electrical resistance power supply circuit if the resulting value is less than a predetermined threshold value.

10 Claims, 3 Drawing Sheets

ELECTRIC ION WITH SAFETY SYSTEM CONTROLLING ELECTRIC HEATER DEPENDING ON TOTAL SUPPLY TIME

CROSS REFERENCE TO RELATED APPLICATION

This is the 35 USC 371 national stage of International Application PCT/FR99/01117 filed on May 11, 1999, which designated the United States of America.

FIELD OF THE INVENTION

The present invention relates to electric irons which comprise a sole plate heated by means of an electric heating resistance and a system of thermal regulation, in which a control member indicates the reference value of the temperature corresponding to the fabric to be ironed, a detector gives the image of the temperature of the sole plate, and a control system controls the opening or the closing, as a function of the difference between the reference temperature and the measured temperature, of the supply circuit of the electric heating resistance.

BACKGROUND OF THE INVENTION

In certain known electric irons of this type, there is provided a safety system detecting the position of the iron, on the heel or on the sole plate, and cutting the supply of the heating resistance when the iron is left in a vertical position on the heel during a period greater than a certain limit.

Such a system is adapted to avoid accidental burning of the user or his surroundings, when the iron is unused and left on. It also permits avoiding the apparatus being subjected to prolonged and useless heating cycles, when the latter is accidentally left on.

Such a system nevertheless has the drawback of using a physical position detector, which increases the cost of the apparatus, increases its size and has decreased reliability with time and the cycles of use.

SUMMARY OF THE INVENTION

The invention proposes overcoming these drawbacks and providing an iron of the type described above, provided with a safety system without a position detector, capable of detecting reliably the stoppage of use of the apparatus.

According to the invention, the iron comprises a safety system having an electronic module which:

a) receives from the control system the information as to closure of the supply circuit of the electric heating resistance, b) produces over a fixed time interval the sum of the durations of supply, c) and opens the supply circuit of the electric heating resistance if the value thus obtained is below a predetermined threshold value.

Thus the system detects a magnitude represented by the quantity of heat delivered by the apparatus, characteristic of contact of the sole with a cloth or with ambient air.

According to an advantageous characteristic of the invention, the electronic module comprises a switch mounted in series with the electric heating resistance, which is actuated in response to a signal delivered by a first counter.

On the other hand, the first counter comprises a programmable integrated circuit, which has at least one supply path, a reception path for a zero set signal, an outlet path, a means for the generation of an activated clock frequency upon turning on the iron.

Moreover, the first counter delivers an opening signal to a relay whose contacts form the switch, when it has carried out an operation of counting of a time lag greater than predetermined time T1, without receiving the zero set signal, T1 being greater than T2.

Preferably, the first counter delivers simultaneously an opening signal to a relay whose contacts form the switch and a lockage signal for the means for generating associated clock frequency to the first counter, after it has carried out a counting operation of a duration greater than a predetermined time T1, without receiving a zero set signal, T1 being greater than T2.

According to another characteristic of the invention, the safety system comprises rearming means that can be actuated by the user, so as to close the relay and reactivate the means for generating clock frequency associated with the first counter, when the iron is on.

The rearming means, when actuated by the user, emit a zero set signal simultaneously to the first and second counter.

According to another embodiment, the safety system comprises an electronic module which:

a) receives from the control system information as to the closure of the supply circuit of the electric heating resistance, b) counts over a fixed time interval the number of alternations between open and closed conditions of the supply circuit of the electric heating resistance, and opens the supply circuit of the electric heating resistance if the number thus obtained is below a predetermined threshold value.

This other embodiment permits, again by observation of the operation of the heating resistance, determining whether the latter is frequently urged to compensate the heat losses of the sole plate, and to cut the supply in the contrary case, which is taken to be characteristic of a nonuse condition.

BRIEF DESCRIPTION OF THE DRAWINGS

The different characteristics as well as the advantages of the invention will become further apparent from the description which follows, given by way of non-limiting example, with reference to the accompanying drawings, in which.

DETAILED DESCRIPTION OF THE INVENTION

Figure 1:
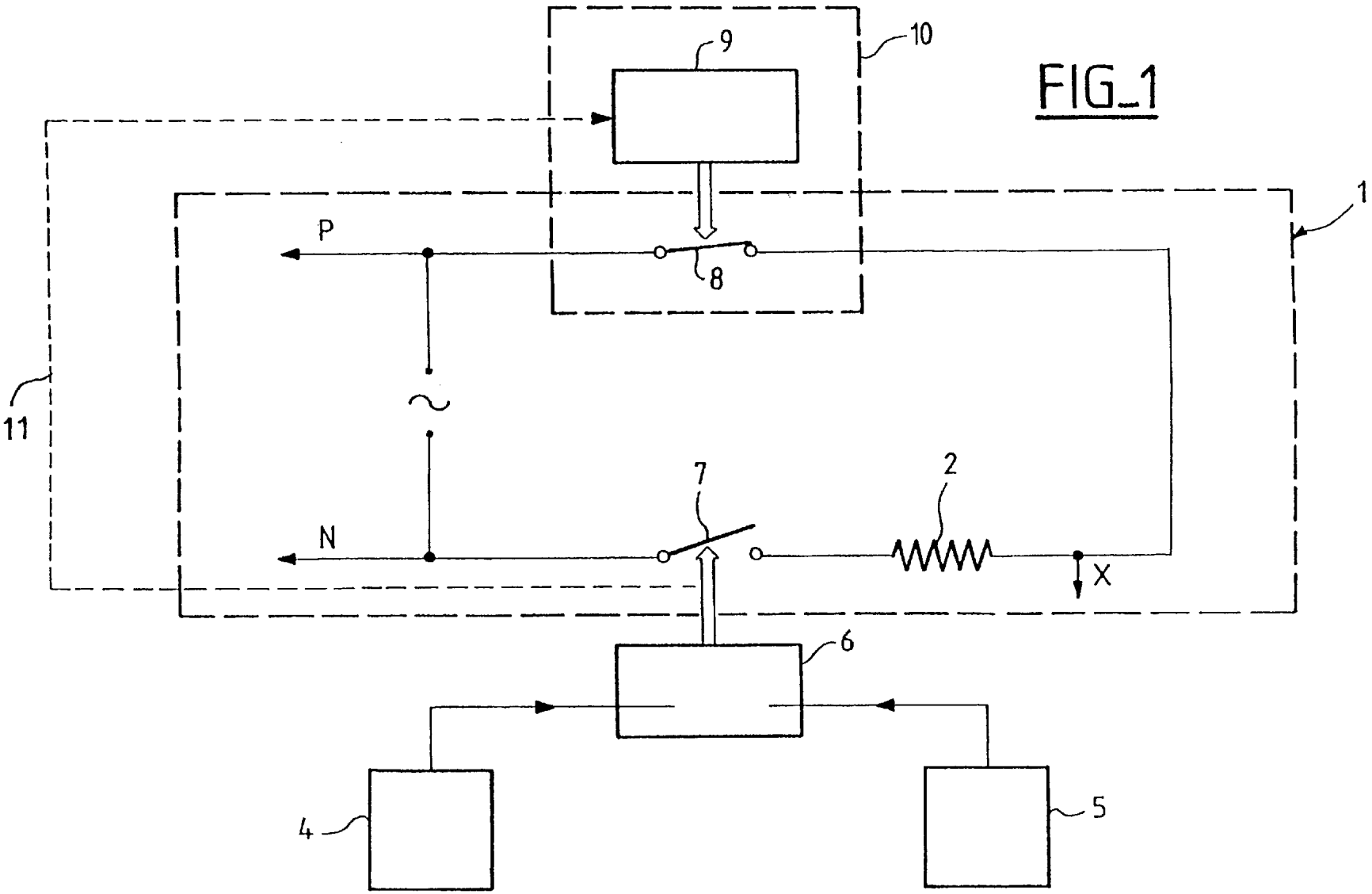
FIG. 1 is an operational diagram of a safety system according to the invention.

In FIG. 1, there is shown the supply circuit 1 of the electric heating resistance (2) adapted to heat the sole plate of an iron, the electric power being supplied by the household supply (3). The iron is either a dry iron or a steam iron.

The temperature of the sole plate is regulated by means of a control member (4), generally actuated by the user, which fixes the reference temperature, by a temperature detector (5) located adjacent the sole plate and which gives the image of the temperature of the sole plate, and a control system (6), which actuates a first switch (7) disposed in the supply circuit (1) of the electric heating resistance (2), as a function of the difference between the temperature of the sole plate and the reference temperature, such that the temperature of the sole plate will be constantly located in a predetermined range about the reference temperature.

At present, this system of regulation is simply constituted by a mechanical thermostat or, in apparatus of a wider range, comprises a potentiometer and electronic regulation means.

The supply circuit (1) of the electric heating resistance (2) comprises, according to the invention, a second switch (8) actuated by an electronic module (9) when the safety system (10) detects a non-use condition of the apparatus beyond a certain limit.

The safety system (10) receives a signal (11) from the control system (6), representative of the condition of the first switch (7), and hence of the supplied or non-supplied condition of the electric heating resistance (2), the second switch (8) being closed under the initial condition of the safety system (10), at the moment of connection of the apparatus to the sector.

Figure 2:
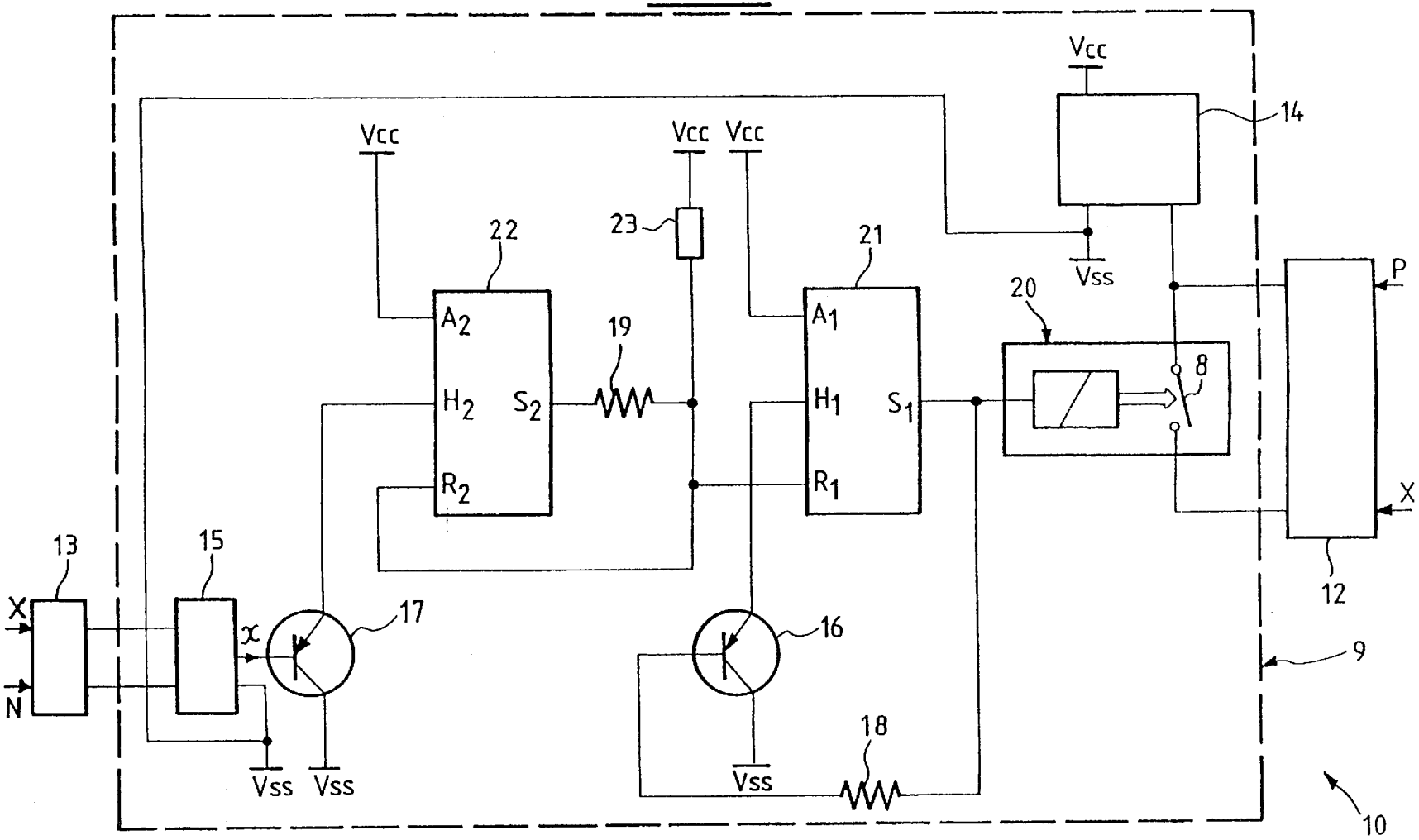
FIG. 2 is an operational diagram of a safety system according to a preferred embodiment of the invention.

In FIG. 2, there is shown a safety system according to a preferred embodiment of the invention, in which the safety system (10) is supplied with alternating current by the domestic network (3), by means of a so-called "positive" route (P) and a so-called "neutral" route (N), said safety system (10) also retaining the potential at one of the terminals of the heating resistance (2) by means of a third path (X), such as said heating resistance (2) namely located between the "neutral" path (N) and the third path (X).

The safety system (10) comprises a first connector (12) with two paths permitting connecting the switch (8) with the heating resistance (2), the two inlet paths being the positive path (P) and the third path (X). The safety system (1) comprises a second connector (13) with two paths, which receives the reference potential by the neutral path (N) and the condition information as to the heating resistance (2) by the third path (X).

The electronic module (9) comprises two modules (14, 15) processing the electric signals passing through the three paths (N, P, X) so as to obtain continuous signals of an intensity permissible to the components, namely respectively a reference potential ($V_{ss}$), a potential ($V_{cc}$) defining with it a supply voltage for the active components of the electronic module (9), and a potential for condition information (x) of the heating resistance (2).

The electronic module (9) comprises a first and second counter (21, 22) each comprising a programmable integrated circuit, which has at least one supply path (A1, A2) set to the potential ($V_{cc}$) when the apparatus is on, a reception path for a zero set signal (R1, R2), and an output path (S1, S2), and means for generating clock frequency supplied by a supply path of the means for generating the clock frequency (H1, H2 ).

The electronic module (9) moreover comprises a first bipolar transistor (16), whose base is connected to the output path (S1) of the first programmable integrated circuit (21) by means of a resistance (18), the emitter is connected to the supply path of the means for generating clock frequency (H1) of the first counter (21), and the collector to the line of reference potential ($V_{ss}$); a second bipolar transistor (17) whose base receives the signal corresponding to the condition information potential (x) of the heating resistance, the emitter is connected to the supply path of the clock frequency generation means (H2) of the second programmable integrated circuit (22), and the collector to the line of reference potential ($V_{ss}$).

The signal delivered by the first counter (21) on its output path (S1) is transmitted to a relay (20), which causes opening of closing of the supply circuit of the heating resistance, via the switch (8) formed by its contacts.

Upon turning on the iron, the means for generating clock frequency of the first counter (21) are supplied and the heating resistance being supplied, the means for generating clock frequency of the second counter (22) are also supplied. The second counter (22) is incremented while the heating resistance (2) is supplied, and carries out the addition of the supply times of said resistance. The second counter (22) emits an end of cycle signal on its outlet path (S2), via a resistance (19), as soon as it has carried out a counting operation of a duration greater than a predetermined time T2. This end of cycle signal is directed toward the zero set path (R2) of the second counter (22) and in parallel to the zero set path (R1) of the first counter (21).

If the first counter (21) has carried out a counting operation of a duration greater than a predetermined time T1, without having received a zero set signal on its reception path (R1), it emits on its outlet path (S1) a signal to the relay (20), which opens the supply circuit of the heating resistance, this cutoff signal also effecting, via the first transistor (16), the blocking of the clock frequency generating means of the first counter.

Rearmament means (23) are provided to permit the user to turn on the iron again and to restart the safety system, when the latter has cut off the supply of the heating resistance following the detection of a prolonged non-use condition.

These re-arming means (23), when they are actuated by the user, emit an impulse on the zero set paths (R1, R2) of the first and second counters (21, 22), which has the effect of re-establishing the outlet path (S1) of the first counter (21) in its initial condition, and thus unblocking its clock frequency generating means and causing, by a new opening signal of the relay (20), the closure of the switch (8) and hence of the supply circuit of the heating resistance (2).

As a result of the system described above, the safety system according to the invention cuts the supply circuit of the heating resistance (2), reversibly thanks to the rearmament means (23) if in the course of a time interval T1, for example of the order of six minutes, the heating time of the heating resistance has not reached a limit T2, for example of the order of 25 seconds, which condition characterizes a non-use condition of the apparatus.

Figure 3A:
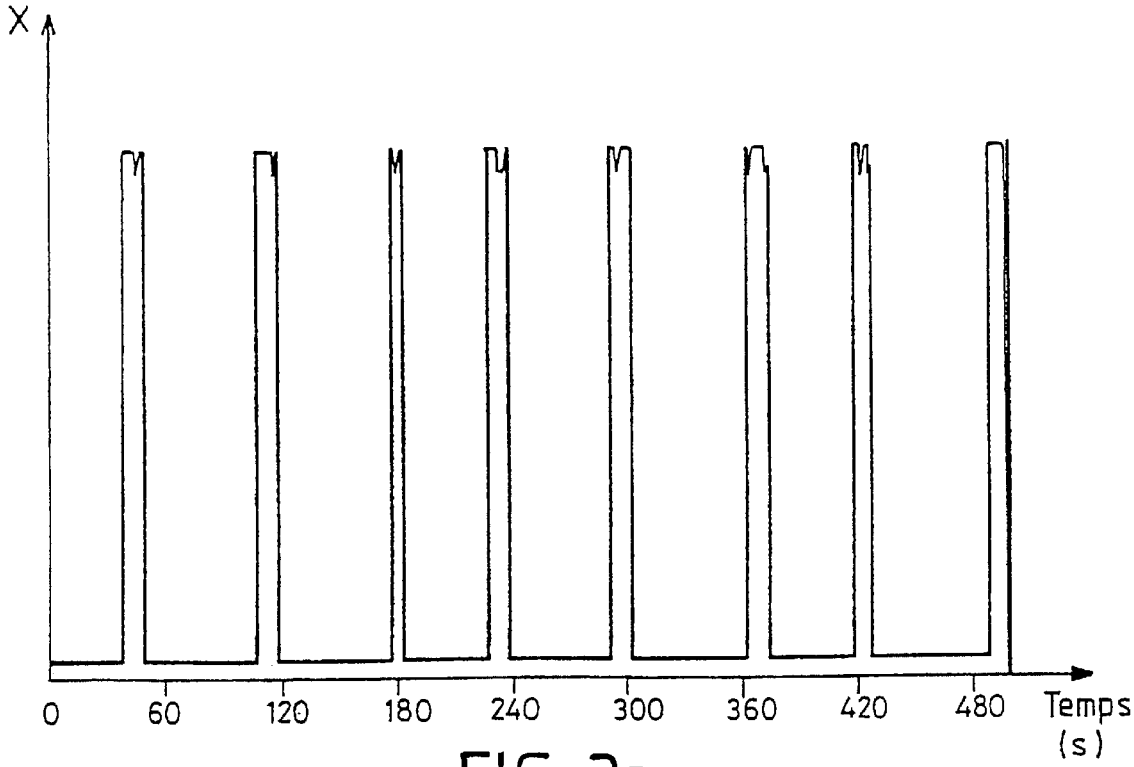
FIG. 3A is a graph connecting the electrical condition of the resistance and time, in a case of use.
Figure 3B:
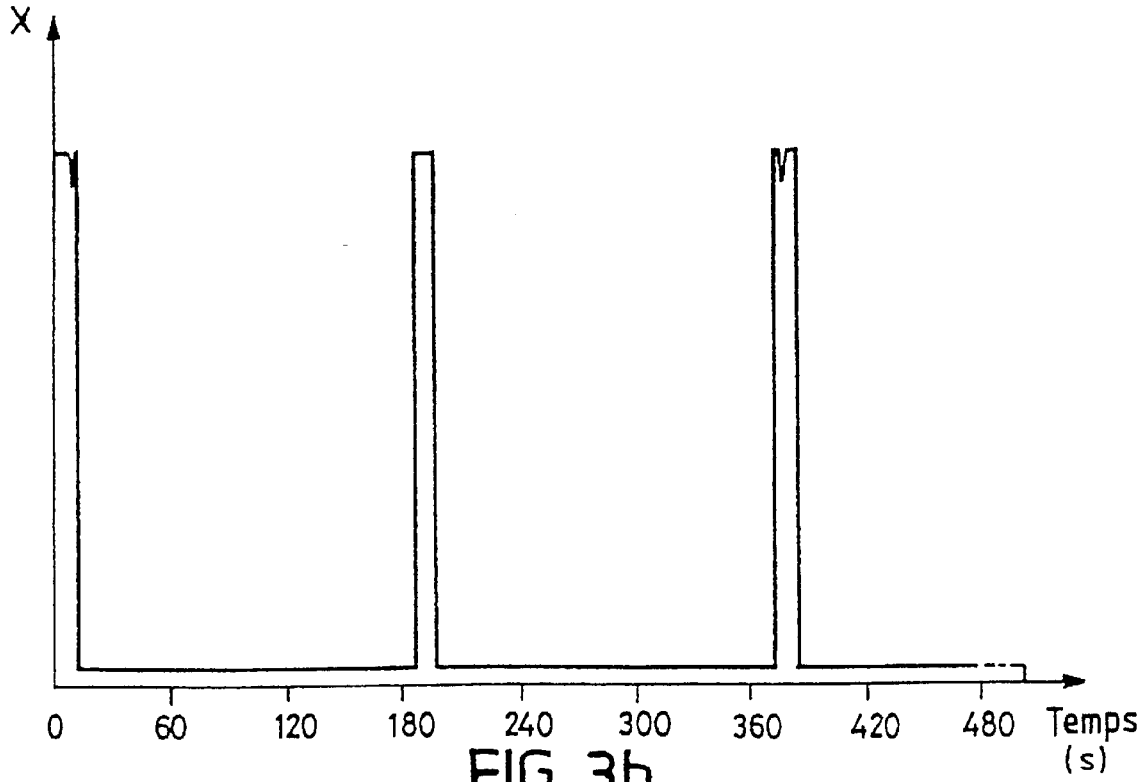
FIG. 3B is a graph connecting the electrical condition of the resistance and time in a case of non-use of an iron.

Thus, as can be seen in FIGS. 3A and 3B, it is possible to characterize a use condition corresponding to the graph 3*a*, relative to a non-use condition corresponding to the graph 3*b*, either by a larger total supply time, or by a higher frequency of the supply phases.

Thanks to this safety system, whether applied to a dry iron or a steam iron, there is obtained a reading of the image of the temperature of the sole plate which reflects either a thermal exchange with a cloth to be pressed to deduce the operating position of the sole plate, or a thermal exchange with the air to deduce the vertical position of the sole plate.

What is claimed is:

1. Electric iron comprising a sole plate heated by means of a heating electric resistance (2) and a system of thermal regulation, in which a control member (4) indicates the reference value of temperature corresponding to the cloth to be pressed, a detector (5) gives the temperature of the sole plate, and a control system (6) controls the opening or closing of the supply circuit (1) of the electric heating resistance (2), as a function of the difference between the reference temperature and the measured temperature, wherein the iron further comprises a safety system (10) comprising an electronic module (9), which:

a) receives from the control system (6) information as to the closure of the supply circuit (1) of the electric heating resistance (2), b) carries out over a fixed time interval the summation of the supply times, and c) opens the supply circuit (1) of the electric heating resistance (2) if the value thus obtained is below a predetermined threshold value.

2. The electric iron according to claim 1, wherein the electronic module (9) comprises a switch (8) mounted in series with the electric heating resistance (2), which is actuated in response to a signal from a first counter (21).

3. The electric iron according to claim 2, wherein the first counter (21) comprises a programmable integrated circuit, which has at least one supply path (A1), a reception path (R1) for a signal set zero, an outlet path (S1), and means for generating clock frequency (H1) activated upon turning on the iron.

4. The electric iron according to claim 3, wherein the electronic module (9) comprises a second counter (22), which comprises a programmable integrated circuit, having at least one supply path (A2), a path for reception of a zero set signal (R2), an outlet path (S2), and means for generating clock frequency (H2) actuated when the electric heating resistance (2) is supplied.

5. The electric iron according to claim 4, wherein the second counter (22) addresses to the first and second counters (21, 22) a zero set signal, since said second counter (22) has carried out a counting operation of a duration greater than a predetermined time T2 without receiving a zero set signal.

6. The electric iron according to claim 5, wherein the first counter (21) delivers an opening signal to a relay (20) whose contacts form the switch (8), since it has carried out a counting operation of a duration greater than a predetermined time T1, without receiving a zero set signal, T1 being greater than T2.

7. The electric iron according to claim 6, wherein the safety system (10) comprises rearmament means (23) that can be actuated by the user so as to close the relay (20) and to reactivate the means for generating clock frequency (H1) associated with the first counter 21, when the iron is on.

8. The electric iron according to claim 7, wherein the rearmament means (23), when actuated by the user, emit a zero set signal simultaneously toward the first and second counters (21, 22).

9. The electric iron according to claim 5, wherein the first counter (21) simultaneously delivers an opening signal to a relay (20) whose contacts form the switch (8) and a blocking signal of the clock frequency generating means (H1) associated with the first counter (21), then there has been carried out a counting operation of a duration greater than a predetermined time T1, without receiving a zero set signal, T1 being greater than T2.

10. Electric iron comprising a sole plate heated by means of an electric heating resistance (2) and a system of thermal regulation, in which a control member (4) indicates the reference value of temperature corresponding to the cloth to be ironed, a detector (5) gives the temperature of the sole plate, and a control system (6) controls the opening and closing of the supply circuit (1) of the electric heating resistance (2), as a function of the difference between the reference value and the measured value, wherein the iron further comprises a safety system (10) comprising an electronic module (9), which receives from the control system (6) information as to closure of the supply circuit (1) of the electric heating resistance (2), counts over a fixed time interval the number of alternations between open and closed conditions of the supply circuit (1) of the electric heating resistance (2), and opens the supply circuit (1) of the electric heating resistance (2) if the number thus obtained is below a predetermined threshold value.

* * * * *